US006152778A

United States Patent [19]

Dalton

[11] Patent Number: 6,152,778

[45] Date of Patent: Nov. 28, 2000

[54] ELECTRONIC CONNECTOR ADAPTER WITH POWER INPUT

[75] Inventor: Dan L. Dalton, Greeley, Colo.

[73] Assignee: Hewlett-Packard Company, Palo Alto, Calif.

[21] Appl. No.: 09/031,219

[22] Filed: Feb. 26, 1998

[51] Int. Cl.[7] ..... H01R 25/00

[52] U.S. Cl. ..... 439/638; 439/502

[58] Field of Search ..... 439/638, 502

[56] References Cited

U.S. PATENT DOCUMENTS

| | | | |
|---|---|---|---|
| 4,981,438 | 1/1991 | Bekhiet | 439/502 |
| 5,411,416 | 5/1995 | Balon et al. | 439/639 |
| 5,573,425 | 11/1996 | Morisawa et al. | 439/502 |
| 5,575,690 | 11/1996 | Eaton | 439/717 |
| 5,775,939 | 7/1998 | Brown | 439/502 |
| 6,098,127 | 8/2000 | Kwang | 710/62 |

FOREIGN PATENT DOCUMENTS

| | | |
|---|---|---|
| 0701303 | 3/1996 | European Pat. Off. . |
| 297 02 618 U | 10/1997 | Germany . |

*Primary Examiner*—Neil Abrams
*Assistant Examiner*—Michael C. Zarroli
*Attorney, Agent, or Firm*—Augustus W. Winfield

[57] ABSTRACT

A connector adapter enabling power to be provided to a portable electronic device through a combined power and signal connector. In a specific example system, power for a portable electronic device is provided through a serial data connector. A serial I/O cable has a device end and a computer end. The computer end of the cable has a connector that includes a socket for receiving a power jack from a separate power supply. The adapter enables external power to be connected when the portable electronic device is operating alone. The adapter is similar to the computer end of the I/O cable, comprising a serial data connector that includes a socket for receiving a power jack from the separate power supply.

2 Claims, 3 Drawing Sheets

ELECTRONIC CONNECTOR ADAPTER WITH POWER INPUT

FIELD OF INVENTION

This invention relates generally to connectors for computer peripheral devices and cables between computers and computer peripheral devices and more specifically to an adapter for an input/output signal connector having a power supply input.

BACKGROUND OF THE INVENTION

Many portable electronics devices are adapted to receive power from a separate small power supply that is built directly onto a plug for inserting into an AC power main. The separate power supply may provide regulated DC power, or may only provide rectified AC for regulation within the portable device.

Computers commonly transfer data to and from various peripheral devices such as printers and scanners through signal cables commonly called input/output (I/O) cables. Common cable standards in the personal computer industry include serial I/O (RS-232), parallel I/O (sometimes called Centronics), and Small Computer Standard Interface (SCSI).

It is common for portable computer peripheral devices to have two separate connectors and two separate cables for data transfer and for power. There is a need to minimize the number of connectors and cables on a portable device to enable smaller, lighter, maneuverable devices.

FIG. 1 shows one prior art solution. A peripheral device 100 has a permanently affixed cable 102 that in turn is connected to a computer I/O connector 104. Connector 104 is connected to a computer 108. A separate power supply 106 is also electrically connected to the connector 104. The peripheral device 100 is powered by the power supply 106 through connector 104.

For peripheral devices such as cameras and hand-held scanners, an I/O cable such as an RS-232 cable is relatively stiff and would hinder freedom of movement. Therefore, cameras and scanners preferably operate independently using battery power and internal data storage. Then, after images are captured, the images may be sent to a computer, to a printer, to a mass memory device, or to a communications device such as a portable telephone. For extended use in an area where AC power is conveniently available, it may be preferable to operate the devices from external power. Alternatively, a power supply connection may be needed to charge internal batteries. In general, there is a need to make cameras and hand-held scanners small, light and maneuverable. Eliminating one connector and one cable from the peripheral device enables a smaller, lighter, more maneuverable peripheral device. There is a need for additional configuration flexibility for portable electronics devices that are battery powered but which may use a separate power supply when convenient or may use a separate power supply for recharging.

SUMMARY OF THE INVENTION

An adapter is provided for external power when the portable electronic device is operating alone. The adapter comprises a data connector that includes a socket for receiving a power jack from the separate power supply. There is no data cable. That is, the adapter is used only for providing power. The adapter enables a design that has all the advantages of the prior art (there is no need for a separate connector and cable for power to the portable electronic device) with the additional advantage of enabling the portable electronic device to be powered by a separate power supply without having to be connected to a computer.

DETAILED DESCRIPTION OF THE PREFERRED EMBODIMENT OF THE INVENTION

Figure 2:
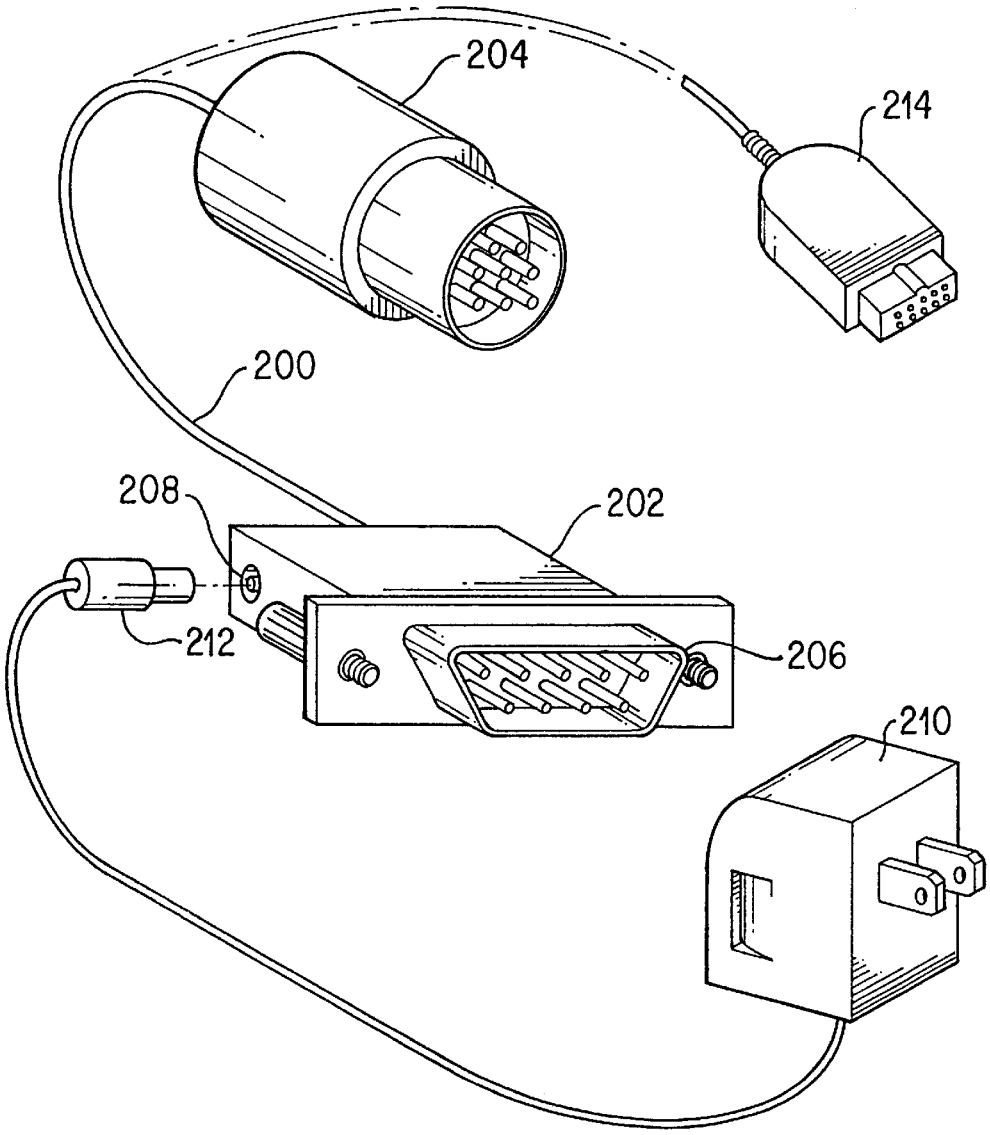
FIG. 2 PRIOR ART
FIG. 2 (prior art) is a block diagram of a specific example embodiment of a power cable system to be used in conjunction with the adapter of the invention.

FIG. 2 illustrates a specific example I/O cable system. In FIG. 2, a serial I/O cable 200 has a connector shell 202 at the computer end and an 8-pin round connector 204 at the peripheral end. The connector shell 202 includes a 9-pin serial RS-232 connector 206 and a socket 208 for receiving a power jack. A separate power supply 210 provides DC power at a power jack 212. Power jack 212 may be inserted into socket 208. Six lines in the cable 204 are used for data transfer and 2 lines are used for power and power ground from the power supply 210. Connector 214 illustrates an alternative to connector 204. Connector 214 has a header that has two rows with five sockets per row. Both connector 204 and connector 214 are commonly used for I/O interfaces for small computing devices such as small hand-held computers. Connectors 202, 204 and 214 are not drawn to scale in that connecter 204 is substantially larger than connectors 202 and 214.

Figure 1:
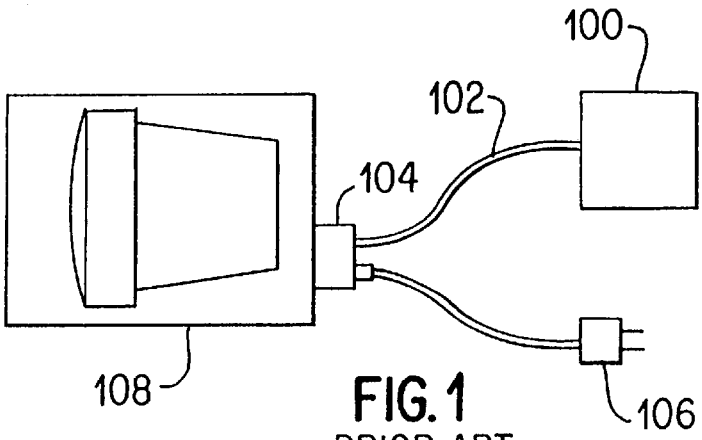
FIG. 1 PRIOR ART
FIG. 1 (prior art) is a block diagram of a system with an I/O cable that includes a power connector.
Figure 3:
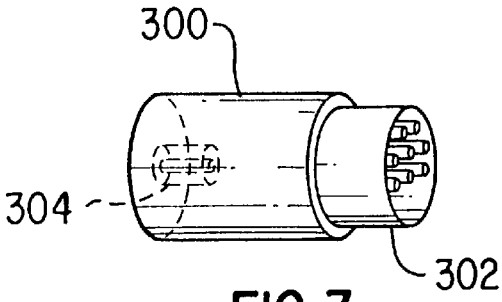
FIG. 3 is a simplified perspective view of an adapter in accordance with the invention.
Figure 5:
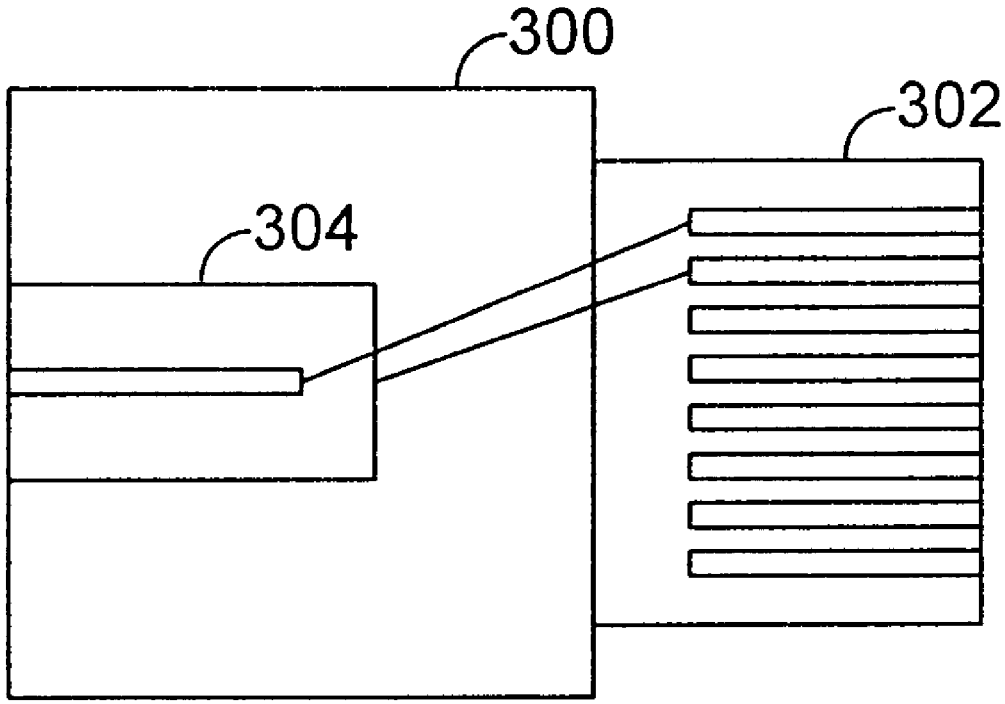
FIG. 5 is a block diagram schematic of the adapter of FIG. 3.

FIG. 3 illustrates an adapter for the system illustrated in FIG. 2. In FIG. 3, adapter 300 has a peripheral end 302 compatible with connector 204 or 216 in FIG. 2. Adapter 300 includes a socket 304 for receiving a power jack (for example, power jack 212 in FIG. 2). An adapter may also be constructed using a header with sockets as illustrated by connector 214 in FIG. 2. The signal pins in adapter 300 (or an adapter based on connector 214) are not connected. The adapter is used for power only. For the adapter, at least two pins or sockets are needed for power and ground and none of the signal pins need to be connected (see FIG. 5).

Figure 4:
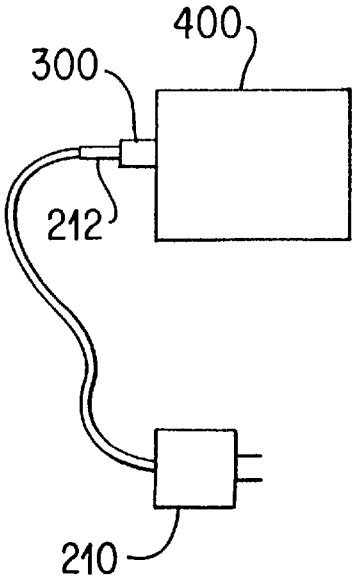
FIG. 4 is a block diagram of a system with the adapter of FIG. 3.

FIG. 4 illustrates the use of the adapter. In FIG. 4, adapter 300 receives the power jack 212 from the separate power supply 210. Adapter 300 in turn is connected to a portable peripheral device 400. Adapter 300 then allows the peripheral device 400 to receive external power when the peripheral device is operating alone without requiring the peripheral device 400 to be connected to an I/O cable. In addition, internal batteries may be charged without requiring the peripheral device to be connected to an I/O cable.

The foregoing description of the present invention has been presented for purposes of illustration and description. It is not intended to be exhaustive or to limit the invention to the precise form disclosed, and other modifications and variations may be possible in light of the above teachings. The embodiment was chosen and described in order to best explain the principles of the invention and its practical application to thereby enable others skilled in the art to best utilize the invention in various embodiments and various modifications as are suited to the particular use contemplated. It is intended that the appended claims be construed to include other alternative embodiments of the invention except insofar as limited by the prior art.

What is claimed is:

1. An adapter comprising:

a first connector, the first connector adapted to receive a power connector;

a second connector, the second connector having at least two contacts for power, the second connector adapted to mate with a signal connector, the signal connector having at least two contacts for power and at least one contact for a signal other than power; and the first connector having contacts connected only to the power contacts of the second connector, thereby enabling power to be transmitted through the second connector to the signal connector without any signal connections to the second connector.

2. A method of providing power to an electronic device, the electronic device including a signal connector, the signal connector having at least one contact adapted to conduct a signal other than power:

connecting, on a first connector on an adapter, at least two contacts to power;

connecting, in the adapter, contacts in a second connector, only to the contacts in the first connector that are connected to power, so that contacts in the second connector are only connected to power and are not electrically connected to any signal lines other than power; and connecting the second connector to the signal connector on the electronic device, so that some contacts in the signal connector are electrically connected to power and all other contacts in the signal connector are not electrically connected to any signal lines other than power.

* * * * *

UNITED STATES PATENT AND TRADEMARK OFFICE

CERTIFICATE OF CORRECTION

PATENT NO. : 6,152,778
DATED : November 28, 2000
INVENTOR(S) : Dan L. Dalton

It is certified that error appears in the above-identified patent and that said Letters Patent is hereby corrected as shown below:

Column 2,
Line 38, delete “204” and insert therefor -- 202 --
Line 39, delete “202” and insert therefor -- 204 --
Line 43, delete “216” and insert therefor -- 214 --

Signed and Sealed this

Thirty-first Day of December, 2002

JAMES E. ROGAN
*Director of the United States Patent and Trademark Office*